US008543391B2

(12) United States Patent
Kang et al.

(10) Patent No.: US 8,543,391 B2
(45) Date of Patent: Sep. 24, 2013

(54) METHOD AND APPARATUS FOR IMPROVING SOUND QUALITY

(75) Inventors: Hong Goo Kang, Seoul (KR); Min Seok Choi, Seoul (KR); Ho Seon Shin, Seoul (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 108 days.

(21) Appl. No.: 13/230,824

(22) Filed: Sep. 12, 2011

(65) Prior Publication Data

US 2012/0123770 A1 May 17, 2012

(30) Foreign Application Priority Data

Nov. 17, 2010 (KR) ..... 10-2010-0114221

(51) Int. Cl.
*G10L 21/02* (2013.01)

(52) U.S. Cl.
USPC ..... 704/226; 704/200; 704/215; 704/233

(58) Field of Classification Search
USPC ..... 704/225, 226, 227, 228, 233; 381/71.1, 381/94.1, 73.1; 702/190; 706/22, 24
See application file for complete search history.

(56) References Cited

U.S. PATENT DOCUMENTS

| | | | | |
|---|---|---|---|---|
| 5,748,725 | A * | 5/1998 | Kubo | 379/392.01 |
| 6,151,397 | A * | 11/2000 | Jackson et al. | 381/71.4 |
| 6,766,176 | B1 * | 7/2004 | Gupta et al. | 455/550.1 |
| 8,204,742 | B2 * | 6/2012 | Yang et al. | 704/209 |
| 8,295,502 | B2 * | 10/2012 | Marton | 381/71.1 |
| 2004/0057586 | A1 * | 3/2004 | Licht | 381/94.7 |
| 2005/0246170 | A1 * | 11/2005 | Vignoli et al. | 704/226 |
| 2008/0004872 | A1 * | 1/2008 | Nordholm et al. | 704/226 |
| 2008/0147392 | A1 * | 6/2008 | Shaffer et al. | 704/233 |
| 2008/0249772 | A1 * | 10/2008 | Martynovich et al. | 704/233 |
| 2012/0121096 | A1 * | 5/2012 | Chen et al. | 381/57 |
| 2012/0221329 | A1 * | 8/2012 | Harsch | 704/225 |

FOREIGN PATENT DOCUMENTS

| | | | |
|---|---|---|---|
| KR | 10-0761681 | B1 | 9/2007 |
| KR | 10-2009-0039159 | A | 4/2009 |

* cited by examiner

*Primary Examiner* — Huyen X. Vo
(74) *Attorney, Agent, or Firm* — Husch Blackwell LLP

(57) ABSTRACT

Disclosed is a method of improving a sound quality, including: receiving a transmission signal of a first user equipment; removing noise in the transmission signal using noise information of the first user equipment side; performing speech reinforcement with respect to the noise removed transmission signal using noise information of a second user equipment side; and transmitting the speech reinforced transmission signal to the second user equipment.

12 Claims, 2 Drawing Sheets

METHOD AND APPARATUS FOR IMPROVING SOUND QUALITY

CROSS-REFERENCE TO RELATED APPLICATIONS

This application claims priority to and the benefit of Korean Patent Application No. 10-2010-0114221 filed in the Korean Intellectual Property Office on Nov. 17, 2010, the entire contents of which are incorporated herein by reference.

TECHNICAL FIELD

The present invention relates to a method and apparatus for improving a sound quality of a user equipment in a communication environment.

BACKGROUND

A scheme for sound quality improvement in a user equipment includes a speech enhancement and a speech reinforcement.

The speech enhancement indicates processing of removing noise included in a speech signal. In a circumstance where two users are communicating with each other, background noise present in a user speaking is input to a microphone together with speech and thereby is transferred to a user listening, which degrades the articulation of speech. To solve the above problem, after performing speech enhancement processing for removing noise in a signal input into a microphone of a user equipment of the user speaking, the noise removed signal is transmitted to a user equipment of the user listening. That is, input of speech enhancement processing is a speech signal including noise and input or estimated noise information, and output thereof is a noise removed speech signal.

The speech reinforcement indicates processing of adjusting a volume of speech in order to improve the articulation of speech in an environment where noise exists. The speech enhancement is processing for transmitting only clear speech to the user listening by removing noise in the signal input into the microphone, and the speech reinforcement is processing for increasing the articulation of speech by amplifying a magnitude of a speech signal received from the user speaking. When noise exists in a communication environment, speech of the user speaking output from a speaker is not clearly audible. In this case, a user equipment may increase the articulation of speech by performing speech reinforcement processing for adjusting the volume of speech and then outputting the reinforced speech to the speaker.

In general, the speech enhancement processing is performed at a rear end of the microphone of the user equipment and functions to remove noise in a speech signal to be transmitted to the user listening and then transmit the noise removed speech signal. Also, the speech reinforcement processing is performed at a front end of the speaker of the user equipment and functions to adjust the volume of speech received from the user speaking and output the volume adjusted speech to the speaker.

SUMMARY

As described above, speech enhancement and speech reinforcement is performed in a user equipment to thereby help the improvement of sound quality. When applying speech enhancement and speech reinforcement processing to the user equipment, an additional operation is required. In general, the user equipment has some constraints according to the use of a high output operation apparatus and thus, the speech enhancement and speech reinforcement processing in the user equipment has to be restricted by an amount of calculations.

Also, the speech reinforcement processing in the user equipment is a scheme of amplifying a speech signal received from a user speaking and assumes that noise is not included in a received signal. However, in most cases, noise is included in the received signal. When amplifying the received signal including noise, the noise is also amplified, which may result in degrading the sound quality. This phenomenon more greatly occurs when a speech enhancement function is not provided in a transmitting user equipment, and relatively weakly occurs when the transmitting user equipment performs speech enhancement processing of removing noise. However, some user equipments have the speech enhancement function and other user equipments do not have the speech enhancement function. A receiving user equipment may not verify whether the transmitting user equipment has the speech enhancement function. Accordingly, when the receiving user equipment receives a signal in which speech enhancement processing is not performed to thereby perform speech reinforcement processing, the sound quality may be degraded. That is, in the case of speech reinforcement processing, the sound quality of a signal received from the user speaking is very important. When a speech enhancement function and a speech reinforcement function are embodied in a user equipment of one side, the user equipment of the one side is unaware of information about a user equipment of another side. Therefore, noise included in the received signal may be amplified through the speech reinforcement processing.

The present invention has been made in an effort to provide a method and system for improving a sound quality by performing speech enhancement processing and speech reinforcement processing at a base station and the like, without having a speech enhancement function and a speech reinforcement function in a user equipment.

An exemplary embodiment of the present invention provides a method of improving a sound quality, including: (a) receiving a transmission signal of a first user equipment; (b) removing noise in the transmission signal using noise information of the first user equipment side; (c) performing speech reinforcement with respect to the noise removed transmission signal using noise information of a second user equipment side; and (d) transmitting the speech reinforced transmission signal to the second user equipment.

(a) through (d) may be performed at a base station.

The noise information of the first user equipment side may be provided from the first user equipment, or may be estimated from the transmission signal of the first user equipment.

The noise information of the second user equipment side may be provided from the second user equipment, or may be estimated from a transmission signal of the second user equipment.

Another exemplary embodiment of the present invention provides an apparatus for improving a sound quality, including: a first speech enhancement unit to remove noise in a transmission signal of a first user equipment using noise information of the first user equipment side; and a first speech reinforcement unit to perform speech reinforcement with respect to the noise removed transmission signal of the first user equipment using noise information of a second user equipment side.

The sound quality improvement apparatus may further include: a second speech enhancement unit to remove noise in a transmission signal of the second user equipment using the noise information of the second user equipment side; and a second speech reinforcement unit to perform speech reinforcement with respect to the noise removed transmission signal of the second user equipment using the noise information of the first user equipment side.

The sound quality improvement apparatus may be installed at a base station.

Still another exemplary embodiment of the present invention provides a base station including: a receiver to receive a transmission signal of a first user equipment; a first speech enhancement unit to remove noise in the transmission signal of the first user equipment using noise information of the first user equipment side; a first speech reinforcement unit to perform speech reinforcement with respect to the noise removed transmission signal of the first user equipment using noise information of a second user equipment side; and a transmitter to transmit the speech reinforced transmission signal of the first user equipment to the second user equipment.

The receiver may further receive a transmission signal of the second user equipment. The base station may further include: a second speech enhancement unit to remove noise in a transmission signal of the second user equipment using the noise information of the second user equipment side; and a second speech reinforcement unit to perform speech reinforcement with respect to the noise removed transmission signal of the second user equipment using the noise information of the first user equipment side. The transmitter may further transmit the speech reinforced transmission signal of the second user equipment to the first user equipment.

According to exemplary embodiments of the present invention, by performing speech enhancement processing and speech reinforcement processing at a base station and the like, all of user equipments may be provided with high sound quality and the sound quality may be integrally managed.

According to exemplary embodiments of the present invention, even though a user equipment of one side does not have information about whether a user equipment of another side has a speech enhancement processing function, the sound quality may be improved through speech reinforcement processing at a base station and the like.

According to exemplary embodiments of the present invention, by performing speech enhancement processing and speech reinforcement processing at a base station and the like, substantially constraints disappear in terms to an amount of calculations used for the speech enhancement processing and the speech reinforcement processing. Each user equipment does not need to separately have hardware or software for the speech enhancement processing and the speech reinforcement processing and thus, it is possible to improve the sound quality.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
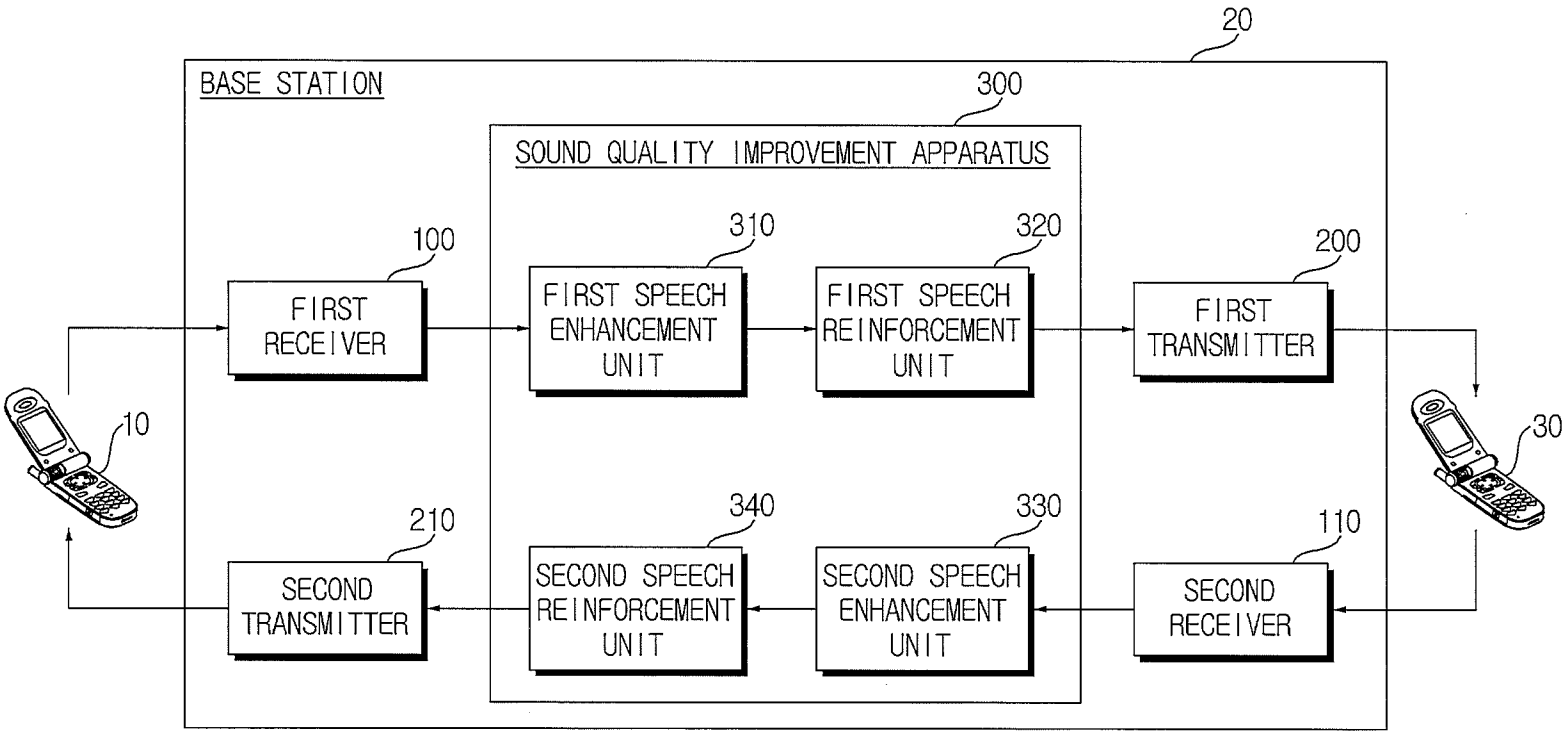
FIG. 1 is a diagram illustrating a configuration of a sound quality improvement apparatus and a base station according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings.

FIG. 1 is a diagram illustrating a configuration of a sound quality improvement apparatus 300 and a base station 20 including the sound quality improvement apparatus 300 according to an exemplary embodiment of the present invention. In the exemplary embodiment, the base station 20 corresponds to an apparatus that relays communication between user equipments within a cell managed by the base station 20. The base station 20 corresponds to an apparatus that receives a signal transmitted from a first user equipment 10 to perform predetermined signal processing via a switching center and then transmit the signal to a second user equipment 30, and also receives a signal transmitted from the second user equipment 30 to perform predetermined signal processing via the switching center and then transmit the signal to the first user equipment 10. Even though the exemplary embodiment describes that the sound quality improvement apparatus 300 is included in the base station 20, the sound quality improvement apparatus 300 may be included in any type of apparatus if the apparatus relays signals transmitted and received between two user equipments, for example, a relay station, a repeater, and the like.

The base station 20 includes first and second receivers 100 and 110, first and second transmitters 200 and 210, and the sound quality improvement apparatus 300.

The first and second receivers 100 and 110, each corresponds to a receiving apparatus included in a general base station, and receives a first transmission signal containing a speech signal that the first user equipment 10 desires to transmit to the second user equipment 30, and receives a second transmission signal containing a speech signal that the second user equipment 30 desires to transmit to the first user equipment 10. Even though the first and second receivers 100 and 110 are indicated as separate constituent elements in the exemplary embodiment, the first and second receivers 100 and 110 may be configured as a single receiver. Also, the first and second receivers 100 and 110 function to decode a received signal, and to transfer the decoded signal to the sound quality improvement apparatus 300.

The first and second transmitters 200 and 210, each corresponds to a transmitting apparatus included in a general base station, and transmits the first transmission signal received from the first user equipment 10 to a destination, that is, the second user equipment 30, and transmits the second transmission signal received from the second user equipment 30 to a destination, that is, the first user equipment 10. Also, the first and second transmitters 200 and 210 function to encode a signal transferred from the sound quality improvement apparatus 300, and to power-amplify the signal so that a destination terminal may receive the signal, and thereby transmit the power-amplified signal.

The sound quality improvement apparatus 300 performs speech enhancement processing and speech reinforcement processing with respect to an input signal. Specifically, the sound quality improvement apparatus 300 sequentially performs speech enhancement processing and speech reinforcement processing with respect to the first transmission signal of the first user equipment 10 that is input from the first receiver 100 and then, transfers the first transmission signal to the first transmitter 200. Also, the sound quality improvement apparatus 300 sequentially performs speech enhancement processing and speech reinforcement processing with respect to the second transmission signal of the second user equipment 30 that is input from the second receiver 110 and then, transfers the second transmission signal to the second transmitter 210.

The sound quality improvement apparatus 300 according to the exemplary embodiment includes a first speech enhancement unit 310, a first speech reinforcement unit 320, a second speech enhancement unit 330, and a second speech reinforcement unit 340.

The first speech enhancement unit 310 performs speech enhancement processing of removing noise in the first transmission signal that is transferred from the first receiver 100, using first noise information of the first user equipment 10 side. The first speech enhancement unit 310 requires the first noise information of the first user equipment 10 side. The noise information may be estimated from the first transmission signal transferred from the first receiver 100, or may be directly provided from the first user equipment 10. Here, to be directly provided from the first user equipment 10, the first user equipment 10 may need to have a function of including noise information in a transmission signal and thereby transmitting the same. The first speech enhancement unit 310 removes noise from an input signal using relationship between a magnitude of noise and a magnitude of the input signal, with the first noise information.

The first speech reinforcement unit 320 performs speech reinforcement processing with respect to the noise removed first transmission signal that is transferred from the first speech enhancement unit 310, using second noise information of the second user equipment 30 side. Here, the speech reinforcement processing is to amplify a volume of input clean speech and thereby improve the articulation of speech decreasing due to external noise. The speech reinforcement processing requires information about background noise that is present in a communication environment of a receiving side to which a speech signal is to be output. The information corresponds to the second noise information of the second user equipment 30 side. Background noise of the second user equipment 30 side is, for example, a horning sound of a vehicle, people's voices, and the like, that are coming from the street.

The second noise information required by the first speech reinforcement unit 320 may be estimated from the second transmission signal of the second user equipment 30 that is transferred from the second receiver 110, or may be directly provided from the second user equipment 30. Here, to be directly provided from the second user equipment 30, the second user equipment 30 may need to have a function of generating and transmitting noise information. The first speech reinforcement unit 320 determines a level of amplifying a speech signal using a magnitude and a characteristic of background noise and a magnitude of speech, included in the first transmission signal, with the second noise information, and may use a psychoacoustical model of a human being according to an algorithm. The first speech reinforcement unit 320 may amplify all the speech components at the same level based on the magnitude and characteristic of background noise, or may amplify the speech components at different levels based on time, a frequency, or the time and the frequency.

The second speech enhancement unit 330 performs speech enhancement processing of removing noise in the second transmission signal that is transferred from the second receiver 110, using second noise information of the second user equipment 30 side. The second speech enhancement unit 330 requires the second noise information of the second user equipment 30 side. The noise information may be estimated from the second transmission signal transferred from the second receiver 110, or may be directly provided from the second user equipment 30. Here, to be directly provided from the second user equipment 30, the second user equipment 30 may need to have a function of including noise information in a transmission signal and thereby transmitting the same. The second speech enhancement unit 330 removes noise from an input signal using relationship between a magnitude of noise and a magnitude of the input signal, with the second noise information. That is, the second noise information is simultaneously used in the aforementioned first speech reinforcement unit 320 and the second speech enhancement unit 330.

The second speech reinforcement unit 340 performs speech reinforcement processing with respect to the noise removed second transmission signal that is transferred from the second speech enhancement unit 330, using the first noise information of the first user equipment 10 side. The speech reinforcement processing requires information about background noise that is present in a communication environment of a receiving side to which a speech signal is to be output. The information corresponds to the first noise information of the first user equipment 100 side. That is, the first noise information is simultaneously used in the aforementioned first speech enhancement unit 310 and the second speech reinforcement unit 340.

The first noise information required by the second speech reinforcement unit 340 may be estimated from the first transmission signal of the first user equipment 10 that is transferred from the first receiver 100, or may be directly provided from the first user equipment 10. The second speech reinforcement unit 340 determines a level of amplifying a speech signal using a magnitude and a characteristic of background noise and a magnitude of speech, included in the second transmission signal, with the first noise information. The same speech reinforcement algorithm as used by the first speech reinforcement unit 320 may be used.

The first speech enhancement unit 310 and the first speech reinforcement unit 320 may exchange information, thereby enabling an amplification level of the first speech reinforcement unit 320 to be adjusted based on a speech enhancement performance of the first speech enhancement unit 310. For example, the speech enhancement performance may be different based on noise of a transmitting side. Therefore, when the speech enhancement performance is poor in the first speech enhancement unit 310, the first speech reinforcement unit 320 may set an amplification rate to be low. When the speech enhancement performance is excellent in the first speech enhancement unit 310, the first speech reinforcement unit 320 may set the amplification rate to be high. Similarly, the second speech enhancement unit 330 and the second speech reinforcement unit 340 may also exchange information, thereby enabling an amplification level of the second speech reinforcement unit 340 to be adjusted based on a speech enhancement performance of the second speech enhancement unit 330.

Figure 2:
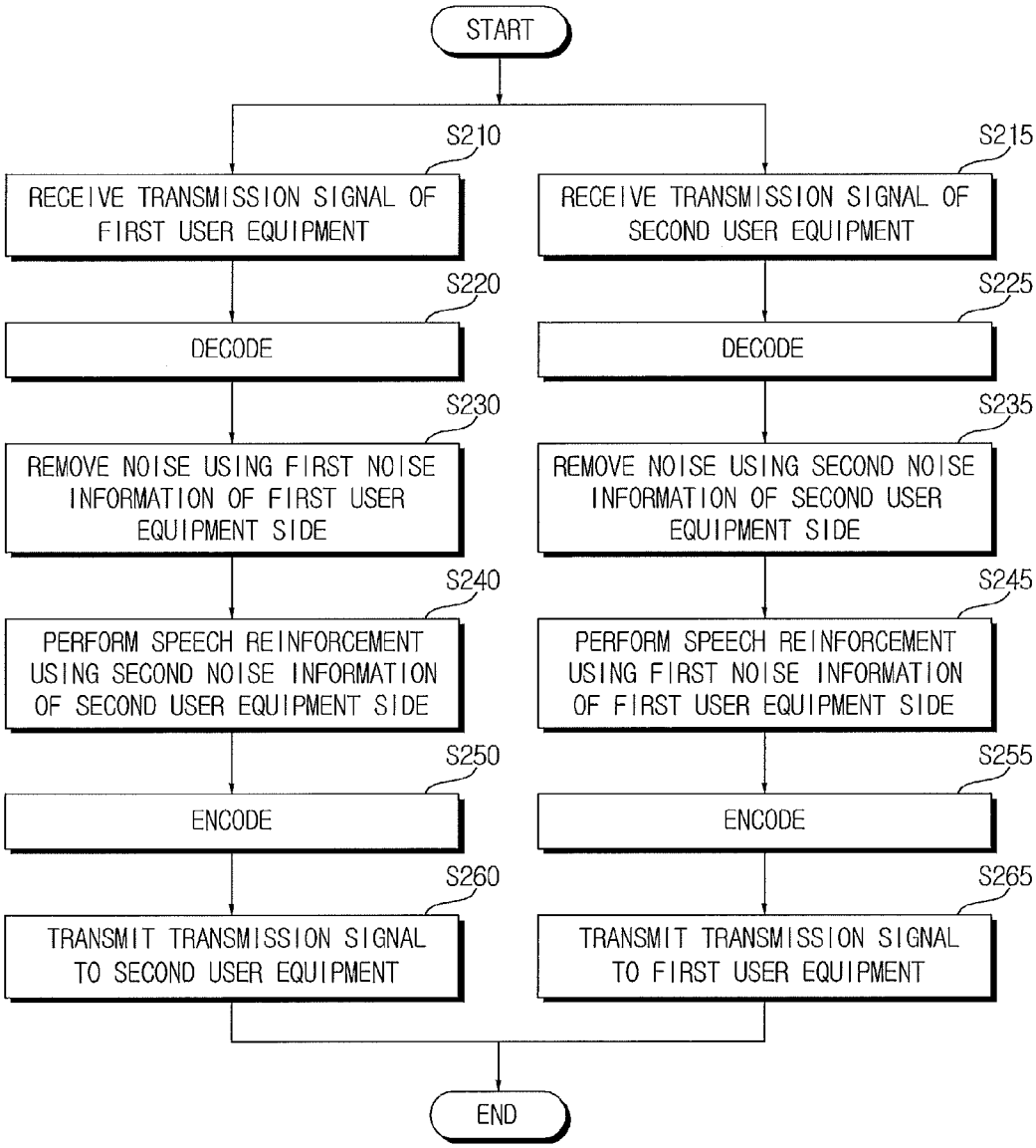
FIG. 2 is a flowchart illustrating a method of improving sound quality according to an exemplary embodiment of the present invention.

FIG. 2 is a flowchart illustrating a method of improving sound quality according to an exemplary embodiment of the present invention. The sound quality improvement method according to the exemplary embodiment includes operations performed in the aforementioned sound quality improvement apparatus and base station. Therefore, even though description is omitted in the following, description described above in relation to the sound quality improvement apparatus and the base station is applied to the sound quality improvement method according to the exemplary embodiment.

When a first transmission signal is received from the first user equipment 10 (S210), the first transmission signal is decoded (S220).

Speech enhancement processing of removing noise using first noise information of the first user equipment 10 side is performed (S230).

Speech reinforcement processing using second noise information of the second user equipment 30 side is performed (S240).

The speech enhanced and speech reinforced first transmission signal is encoded (S250) and is transmitted to the second user equipment 30 (S260).

The following operations S215 through S265 are performed at the same time or sequentially with performing operations S210 through S260.

When a second transmission signal is received from the second user equipment 30 (S215), the second transmission signal is decoded (S225).

Speech enhancement processing of removing noise using second noise information of the second user equipment 30 side is performed (S235). The second noise information used in operation S235 is the same information as the second noise information used in operation S240.

Speech reinforcement processing using first noise information of the first user equipment 10 side is performed (S245). The first noise information used in operation S245 is the same information as the first noise information used in operation S230.

The speech enhanced and speech reinforced second transmission signal is encoded (S255) and is transmitted to the first user equipment 10 (S265).

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method of improving a sound quality, comprising:

(a) receiving a transmission signal of a first user equipment;

(b) removing noise in the transmission signal using noise information of the first user equipment side;

(c) performing speech reinforcement with respect to the noise removed transmission signal using noise information of a second user equipment side; and (d) transmitting the speech reinforced transmission signal to the second user equipment;

wherein the receiving, removing, performing and transmitting steps are performed at a base station but not at the first user equipment and the second user equipment.

2. The method of claim 1, wherein the noise information of the first user equipment side is one of: provided from the first user equipment, and estimated from the transmission signal of the first user equipment.

3. The method of claim 1, wherein the noise information of the second user equipment side is one of: provided from the second user equipment, and estimated from a transmission signal of the second user equipment.

4. An apparatus for improving a sound quality, comprising:

a processor installed in a base station executing instructions to operate as a first speech enhancement unit to remove noise in a transmission signal of a first user equipment using noise information of the first user equipment side; and the processing further executing instructions to operate as a first speech reinforcement unit to perform speech reinforcement with respect to the noise removed transmission signal of the first user equipment using noise information of a second user equipment side;

wherein the first speech enhancement unit and the first speech reinforcement unit are located in the base station, and not at the first user equipment or the second user equipment.

5. The apparatus of claim 4, further comprising:

a processor installed at the base station executing instructions to operate as a second speech enhancement unit to remove noise in a transmission signal of the second user equipment using the noise information of the second user equipment side; and the processor further executing instructions to operate as a second speech reinforcement unit to perform speech reinforcement with respect to the noise removed transmission signal of the second user equipment using the noise information of the first user equipment side.

6. The apparatus of claim 4, wherein the noise information of the first user equipment side is one of: provided from the first user equipment, and estimated from the transmission signal of the first user equipment.

7. The apparatus of claim 4, wherein the noise information of the second user equipment side is one of: provided from the second user equipment, and estimated from a transmission signal of the second user equipment.

8. A base station comprising:

a receiver to receive a transmission signal of a first user equipment;

a processor installed in the base station and executing instructions to operate as a first speech enhancement unit to remove noise in the transmission signal of the first user equipment using noise information of the first user equipment side;

the processing further executing instructions to operate as a first speech reinforcement unit to perform speech reinforcement with respect to the noise removed transmission signal of the first user equipment using noise information of a second user equipment side; and a transmitter to transmit the speech reinforced transmission signal of the first user equipment to the second user equipment;

wherein the first speech enhancement unit and the first speech reinforcement unit are located in the base station, and not at the first user equipment or the second user equipment.

9. The base station of claim 8, wherein:

the receiver further receives a transmission signal of the second user equipment, the base station further comprises:

a processor installed at the base station executing instructions to operate as a second speech enhancement unit to remove noise in a transmission signal of the second user equipment using the noise information of the second user equipment side; and the processor further executing instructions to operate as a second speech reinforcement unit to perform speech reinforcement with respect to the noise removed transmission signal of the second user equipment using the noise information of the first user equipment side, and the transmitter further transmits the speech reinforced transmission signal of the second user equipment to the first user equipment;

wherein the second speech enhancement unit and the second speech reinforcement unit are located in the base station, and not at the first user equipment or the second user equipment.

10. The base station of claim 8, wherein the noise information of the first user equipment side is one of: provided from the first user equipment, and estimated from the transmission signal of the first user equipment.

11. The base station of claim 8, wherein the noise information of the second user equipment side is one of: provided from the second user equipment, and estimated from a transmission signal of the second user equipment.

12. A method of improving a sound quality, comprising:

receiving a first transmission signal of a first user equipment;

removing noise in the first transmission signal using first noise information of the first user equipment side;

performing speech reinforcement with respect to the noise removed first transmission signal using second noise information of a second user equipment side;

transmitting the speech reinforced first transmission signal to the second user equipment;

receiving a second transmission signal of the second user equipment;

removing noise in the second transmission signal using the second noise information of the second user equipment side;

performing speech reinforcement with respect to the noise removed second transmission signal using the first noise information of the first user equipment side; and transmitting the speech reinforced second transmission signal to the first user equipment, wherein the receivings, removings, performings and transmittings are performed at a base station but not at the first user equipment and the second user equipment.

* * * * *